US007341491B2

(12) United States Patent
Zhu et al.

(10) Patent No.: US 7,341,491 B2
(45) Date of Patent: Mar. 11, 2008

(54) MINIATURE AUDIO JACK CONNECTOR WITH IMPROVED CONTACT ARRANGEMENT

(75) Inventors: Zi-Qiang Zhu, Kunshan (CN); Hong-Qiang Han, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/599,658

(22) Filed: Nov. 14, 2006

(65) Prior Publication Data

US 2007/0111607 A1 May 17, 2007

(30) Foreign Application Priority Data

Nov. 14, 2005 (CN) ..... 2005 2 0077822 U

(51) Int. Cl.
*H01R 24/04* (2006.01)

(52) U.S. Cl. ..... 439/669; 439/668

(58) Field of Classification Search ..... 439/668, 439/669

See application file for complete search history.

(56) References Cited

U.S. PATENT DOCUMENTS 3,246,282 A * 4/1966 Mas et al. ..... 439/668
5,338,215 A * 8/1994 Lee et al. ..... 439/188
5,928,034 A * 7/1999 Tabata et al. ..... 439/595
6,270,380 B1 8/2001 Shichida
6,575,793 B1 * 6/2003 Li et al. ..... 439/668

* cited by examiner

*Primary Examiner*—Tho D. Ta
*Assistant Examiner*—Travis Chambers
(74) *Attorney, Agent, or Firm*—Wei Te Chung

(57) ABSTRACT

A miniature audio jack connector (100) for electrically connecting a mating plug (5) includes an insulative housing (1), a number of contacts (2) retained in the housing. The housing defines a plug-insertion hole (12) in a longitudinal direction thereof. The contacts include a second contact (22) and a third contact (23). The second contact includes a second retaining portion (220) and a second elastic arm (221) extending into the plug-insertion hole. The third contact includes a third retaining portion (230) and a third elastic arm (231) extending opposite to the second elastic arm. The second and third retaining portions (220, 230) overlap each other along the longitudinal direction of the housing (1), thereby lengthening the elastic arms (221, 231) of the contacts (22, 23) to be reliable connecting with the mating plug.

17 Claims, 6 Drawing Sheets

MINIATURE AUDIO JACK CONNECTOR WITH IMPROVED CONTACT ARRANGEMENT

BACKGROUND OF THE INVENTION

1. Field of the Invention

This invention generally relates to an audio jack connector, and more particularly to a miniature audio jack connector with reliable structure for mating with a corresponding plug.

2. Description of the Prior Art

U.S. Pat. No. 5,338,215 discloses a conventional audio jack connector comprising an insulative housing and a plurality of contacts accommodated in the insulative housing. The insulative housing includes a plug-insertion hole extending therethrough. The contacts include a first, a second and a third contact retained in a same side of the housing. The first, second and third contacts are arranged in a longitude direction of the insulative housing. Each contact includes a retaining portion, a spring arm extending into the plug-insertion hole for mating with a plug, and a soldering portion extending beyond the same side wall of the insulative hosing for being mounted on a printed circuit board. However, when this contact arrangement is used in a miniature audio jack connector, the elasticity of the spring arms is restricted because the length of the spring arms is not big enough.

Hence, it is desired to have a miniature audio jack connector with improved contact arrangement therefore solving the problem above.

BRIEF SUMMARY OF THE INVENTION

Accordingly, an object of the present invention is to provide a miniature audio jack connector with contacts having good elasticity function.

In order to attain the objective above, a miniature audio jack connector for electrically connecting a mating plug, comprises an insulative housing and a plurality of contacts retained in the housing. The housing includes a base, a cylinder-shaped mating portion extending forwardly from the base, and a plug-insertion hole through the mating portion and the base. The contacts include a first contact, a second contact and a third contact. The top wall defines a set of first, second and third mounting holes along the longitude direction of the housing for accommodating the contacts thereof. Each contact defines a retaining portion fixed in the corresponding mounting hole, an elastic arm extending into the plug-insertion hole, and a soldering portion extending beyond the same side wall of the housing. The second and third retaining portions at least partially overlap with each other in the longitudinal direction of the housing. The second and third retaining portions are spaced apart from each other in a direction substantially perpendicular to the longitudinal direction. With this arrangement, the elastic arms of the contacts are lengthened to be reliable connecting with the mating plug.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims.

The invention, together with its objects and the advantages thereof, may be best understood by reference to the following description taken in conjunction with the accompanying drawings, in which like reference numerals identify like elements in the figures and in which.

DETAILED DESCRIPTION OF THE INVENTION

Reference will now be made in detail to the preferred embodiment of the present invention.

Figure 1:
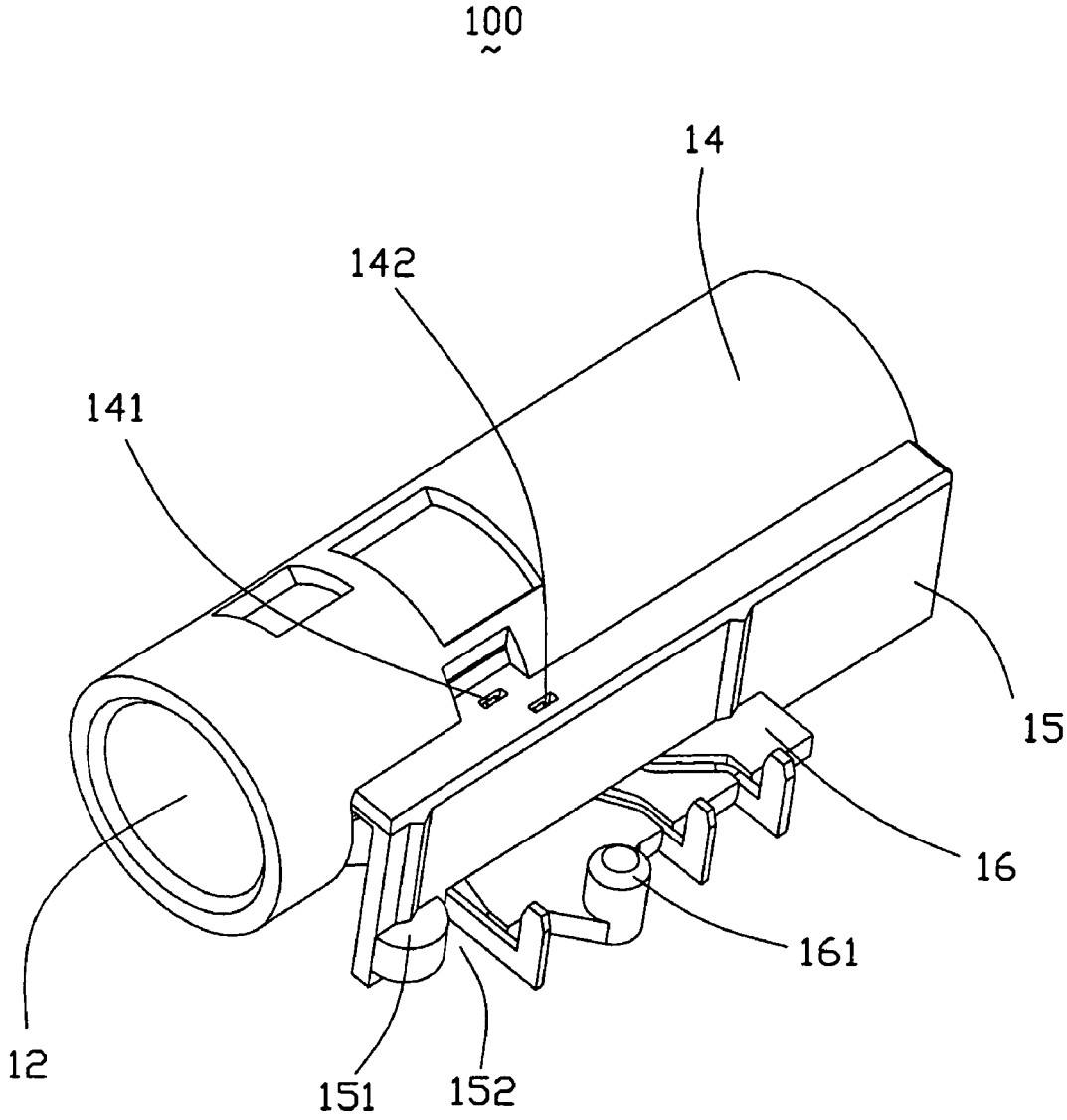
FIG. 1 is a perspective view of a miniature audio jack connector according to the present invention.
Figure 2:
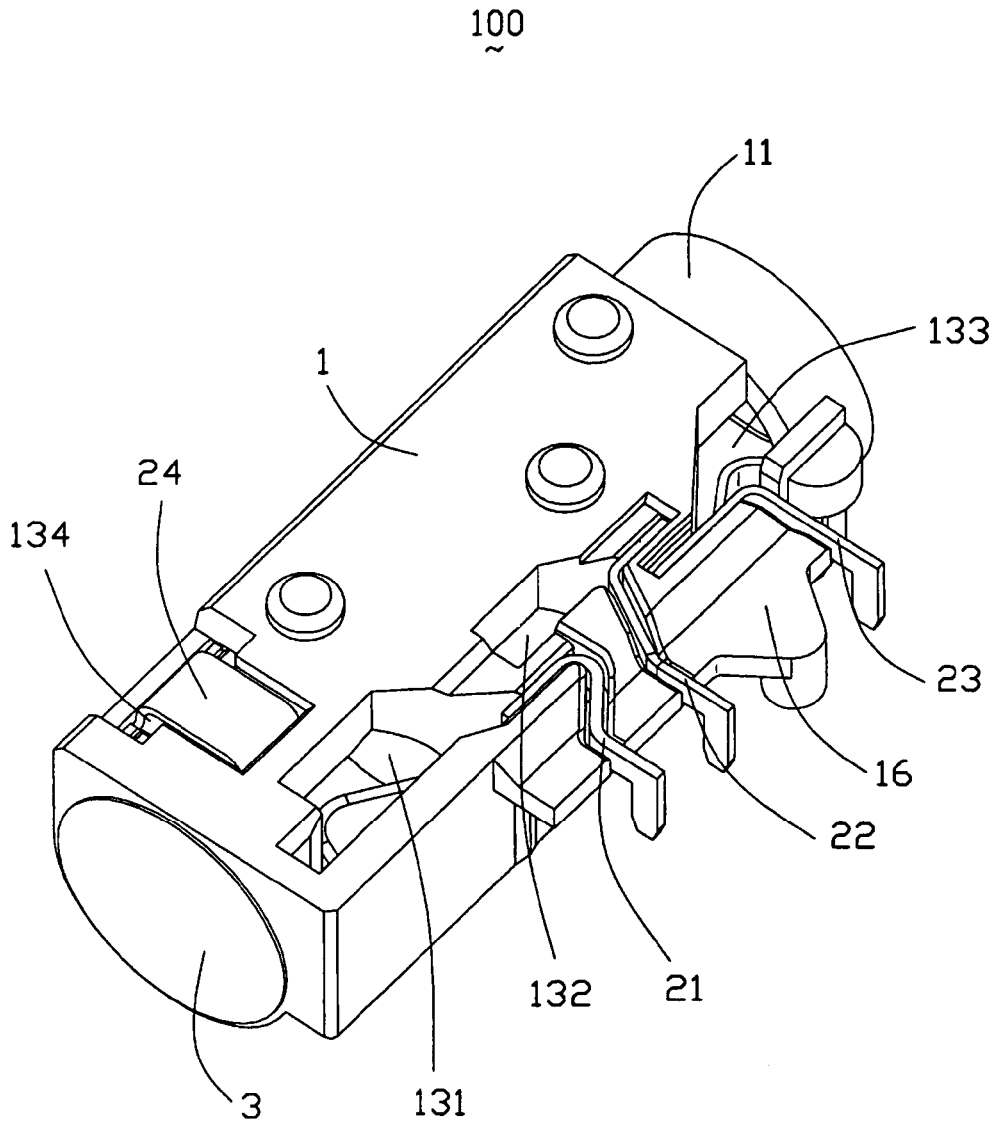
FIG. 2 is another perspective view shown in FIG. 1.

Refer to the drawings and in particular to FIGS. 1-2, a miniature audio jack connector 100 in accordance with the present invention for electrically connecting a mating plug 5 (shown in FIGS. 4-6), comprises an insulative housing 1, a plurality of contacts 2 retained in the insulative housing 1 and a rear cover 3 for locking with the insulative housing 1.

Referring to FIGS. 1-5, the insulative housing 1 comprises a base 10, a cylinder-shaped mating portion 11 extending forwardly from the base 10 and a plug-insertion hole 12 extending through the mating portion 11 and the base 10. The base 10 forms a flat rear wall 17, a top wall 13, a pair of side walls 15, 18 perpendicularly to the top wall 13, and an arched bottom wall 14 opposite to the rear wall 17. A connecting portion 16 is integrally extending outward from the side wall 15. The top wall 13 defines a set of first, second and third mounting holes 131, 132, 133 adjacent to the side wall 15 along the longitude direction of the housing 1. A fourth mounting hole 134 is disposed beside another side wall 18 and opposite to the first mounting hole 131. The mounting holes 131, 132, 133, 134 are in communication with the plug-insertion hole 12 for receiving the contacts 2 thereof. The top wall 13 further defines a plurality of first post 135 for position purpose. The side wall 15 defines a protrusion 151 in front of the connecting portion 16 and forming a gap 152 between the protrusion 151 and the connecting portion 16. The connecting portion 16 includes a second post 161 receivable in a hole 41 defined in a printed circuit board (PCB) 4 for positioning purpose (seen in FIG. 4). The bottom wall 14 is arch shaped and includes a pair of first and second recesses 141, 142 in communication with the mounting holes 132, 133 respectively.

Figure 3:
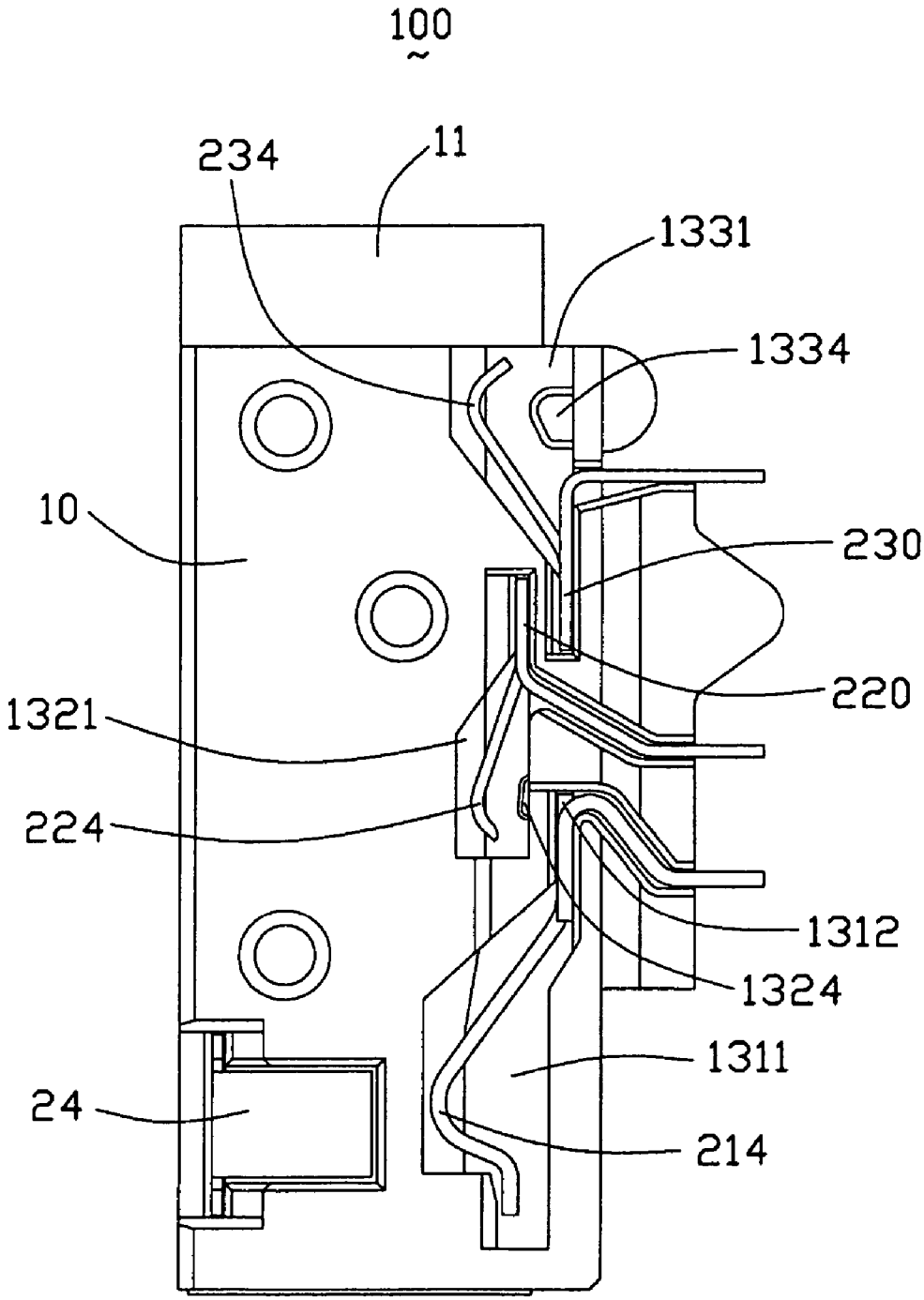
FIG. 3 is a top plan view of the miniature audio jack shown in FIG. 2.
Figure 4:
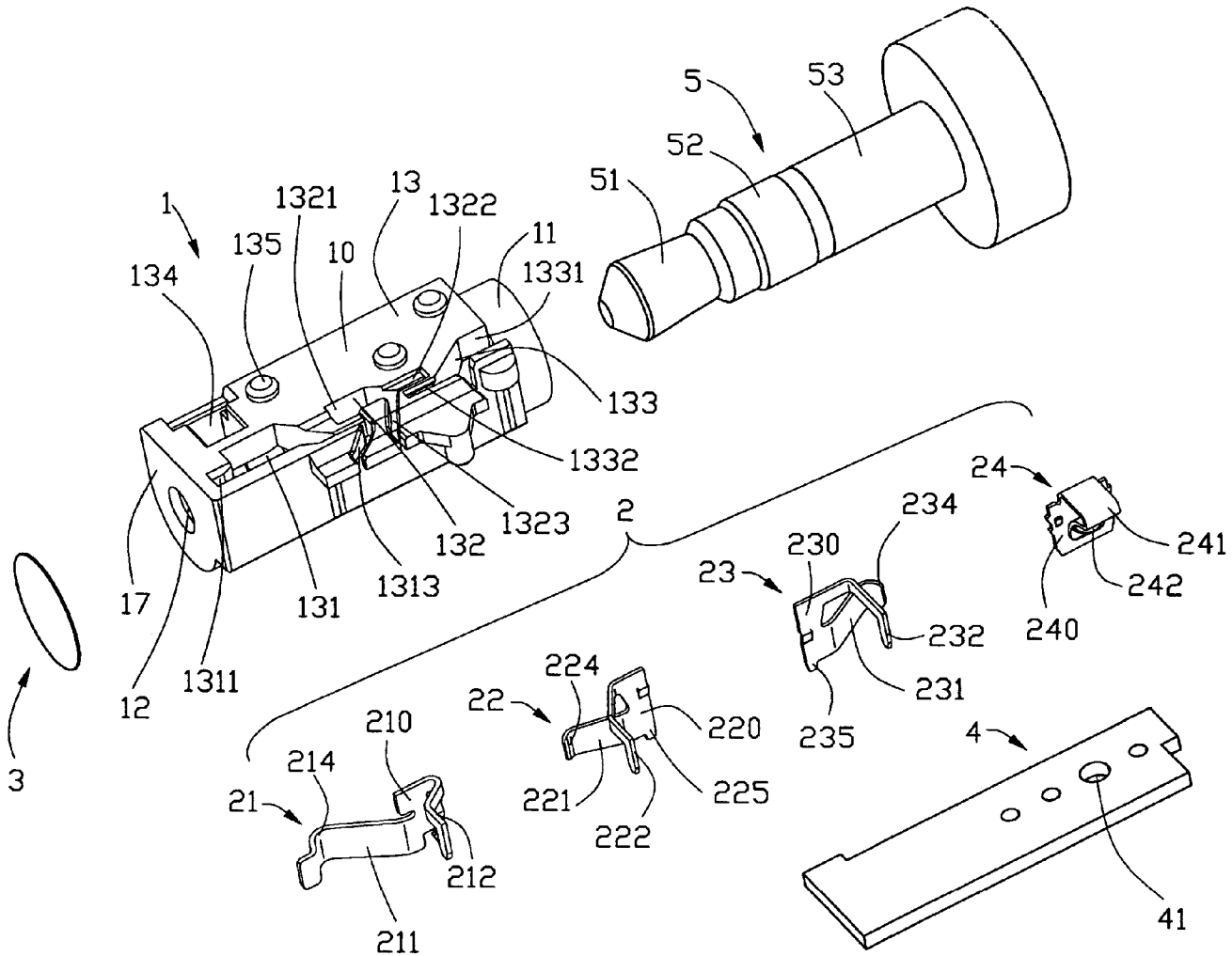
FIG. 4 is an exploded view of the miniature audio jack connector shown in FIG. 1, in conjunction with a plug and a printed circuit board on which the audio jack connector is mounted.
Figure 5:
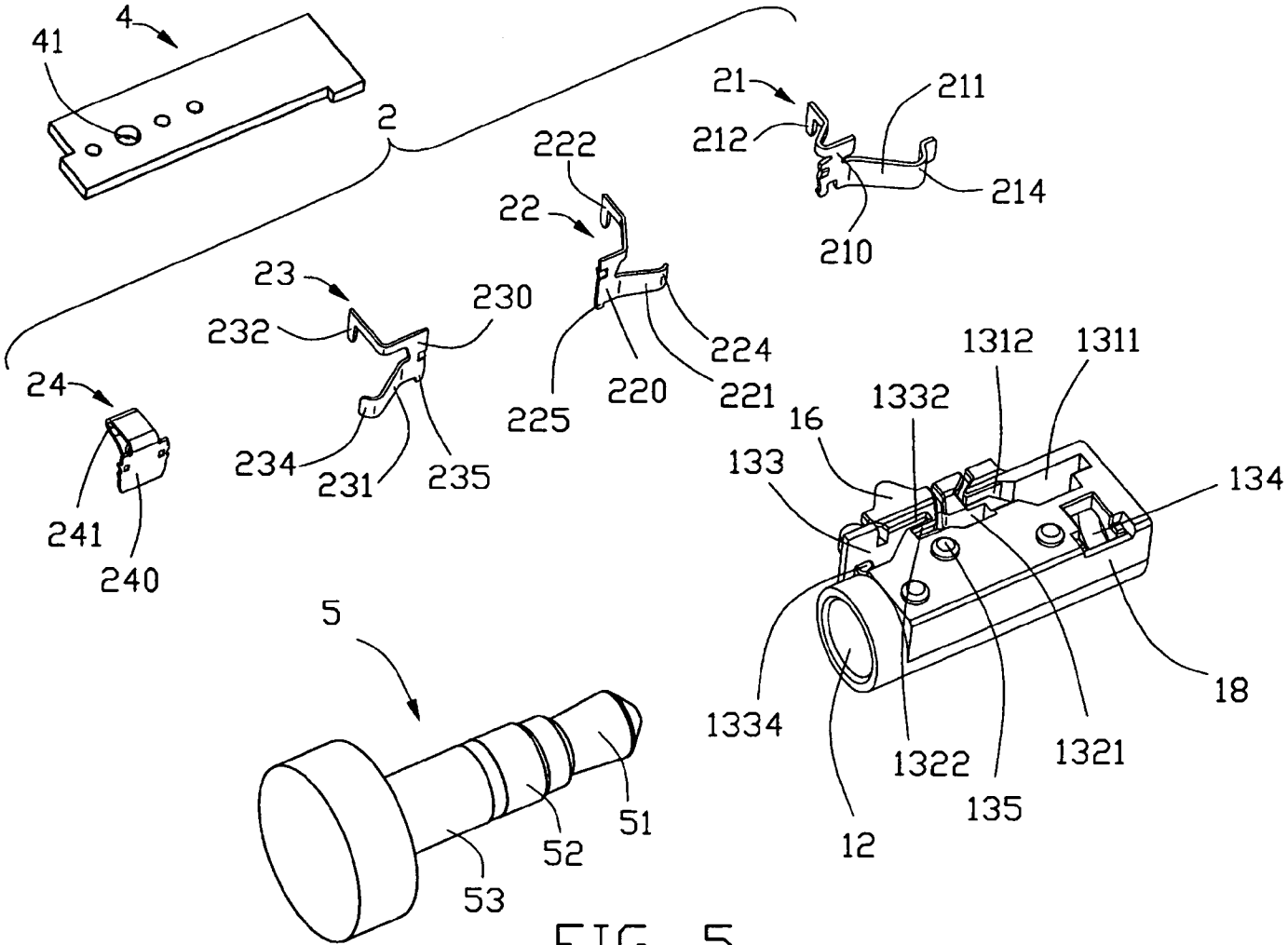
FIG. 5 is another exploded view of FIG. 4.
Figure 6:
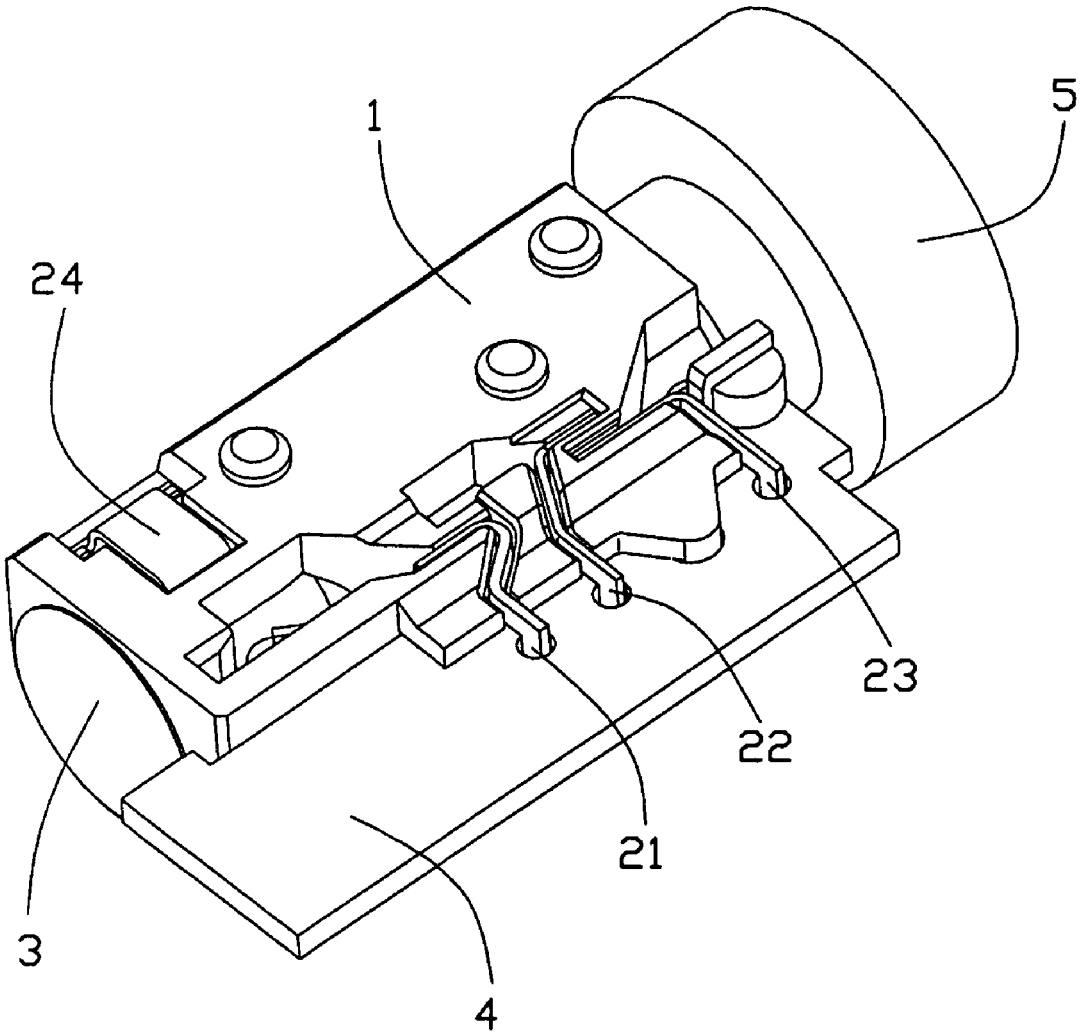
FIG. 6 is a perspective view of the miniature audio jack connector mounted on the printed circuit board with the mating plug inserted therein.

Referring to FIGS. 3-5, the contacts 2 include a first contact 21, a second contact 22, a third contact 23 and a retaining contact 24. All the contacts 21, 22, 23, 24 are made of conductive material and accommodated in the mounting holes 131, 132, 133, 134 respectively from the top wall 13 of the insulative housing 1.

Referring to FIG. 4, the first contact 21 includes a planer shaped first retaining portion 210, a first elastic arm 211 extending forward from the first retaining portion 210, and a first soldering portion 212 extending sideward from the first retaining portion 210. The second contact 22 contains a vertical second retaining portion 220, a second elastic arm 221 extending from the lower side of the retaining portion 220, and a second soldering portion 222 extending from the lower side of the retaining portion 220. The third contact 23 are probably in the same configuration of the second contact 22. The third contact 23 contains a vertical third retaining portion 230, a third elastic arm 231 extending from the lower side of the retaining portion 230, and a third soldering portion 232 extending from the lower side of the retaining portion 230. The first, second and third soldering portions 212, 222 and 232 are L-shaped wherein the soldering portions 212, 222, 232 extend over the elastic arms 211, 221, 231 respectively. The first and second arms 211, 221 extend in a same direction while the second and third arms 221, 231 extend in an opposite direction so as to arrange the contacts 22, 23. The first and second mounting holes 131, 132 are adapted for accommodating the contacts 21, 22 configured to the mounting holes 131, 132 respectively. The first mounting hole 131 defines a first opening 1311 for accommodating the first elastic arm 211; a first slit 1312 extending forward from the first opening 1311 for fixing the first retaining portion 210, and a first slot 1313 in communication of the first slit 1312 for retaining the first soldering portion 212. The second mounting hole 132 is Y-shaped and comprises a second opening 1321 for accommodating the second elastic arm 221, a second slit 1322 extending forward from the second opening 1321 for fixing the second retaining portion 220, and a second slot 1323 in communication of the second slit 1322 for retaining the second soldering portion 222. The third mounting hole 133 defines a third opening 1331 for accommodating the third elastic arm 231 and a third slit 1332 extending backward from the third opening 1331 for fixing the third retaining portion 230. The third soldering portion 232 is extending through the gap 152. The soldering portions 212, 222, 232 are extending beyond the connecting portion 16 from the same side wall 15 of the insulative housing 1, thereby facilitating the soldering portions 212, 222, 232 to be soldered to the PCB 4. Each elastic arm 211, 221, 231 defines an engaging portion 214, 224, 234 projecting into the plug-insertion hole 12 for engaging with the mating plug 5 (seen in FIGS. 4-6). Each planer shaped retaining portion 220, 230 further defines a tab 225, 235 fixed in the first and second recesses 141, 142. The first slit 1312 and third slit 1332 are disposed in a line. The second slit 1322 is set on the left side of the third slit 1332 wherein the second slit 1322 is parallel to the third slit 1332. The second slit 1322 is juxtaposed with respect to the third slit 1332 along the longitude direction of the housing 1. The first and second slots 1313, 1323 are extending through the connecting portion 16. The second and third openings 1321, 1331 respectively include a second position block 1324 and a third position block 1334 wherein the position blocks 1324, 1334 are adapted for abutting against the contacts for over pressure when the mating plug 5 is inserted in the plug-insertion hole 12.

The retaining contact 24 is retained in the fourth mounting hole 134 and includes a stationary portion 240 and a resilient portion 241 extending and bending from the upper edge of the stationary portion 240. The resilient portion 241 further forms a calotte emboss 242 extending into the plug-insertion hole 12 for abutting against the plug 5 and enhancing engaging force.

Referring to FIGS. 4-5, the mating plug 5 comprises a first contact section 51, a second contact section 52 and a third contact section 53. With insertion of the plug 5, the first, second and third contact sections 51, 52 and 53 electrically connect the engaging portions 214, 224 and 234 of the first, second and third elastic arms 211, 221 and 231 respectively.

Comparing with the prior art, the second and third retaining portions 220, 230 at least partially overlap with each other in the longitudinal direction of the housing 1. The second and third retaining portions 220, 230 are spaced apart from each other in a direction substantially perpendicular to the longitudinal direction. With this arrangement, the elastic arms 221, 231 of the contacts 22, 23 are lengthened to be reliable connecting with the mating plug 5. Besides, the L-shaped soldering portions 212, 222, 232 extend beyond the connecting portion 16 from the same side wall 15 of the insulative housing 1, thereby facilitating the soldering portions 212, 222, 232 to be soldered to the PCB 4.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An audio jack assembly comprising:

a printed circuit board;

a tubular type insulative housing located adjacent to the printed circuit board and defining a plug-receiving hole extending along a front-to-back direction;

a contact platform formed on and extending laterally from one lateral side of the insulative housing in a transverse direction perpendicular to said front-to-back direction;

a plurality of terminals disposed in the corresponding passageways, respectively, each of said terminals defining an elastic mating portion extending into the plug-receiving hole and a solder tail exposed outside of the insulative housing around said lateral side to be fastened to the printed circuit board; wherein said platform functions as not only a spacer to regulate the solder tail but also a supporting device holding the housing upon the printed circuit board.

2. The assembly as claimed in claim 1, wherein the solder tails are of an right angle form.

3. The audio jack assembly as claimed in claim 1 wherein each of some of the passageways is dimensioned to be large enough and communicate with an exterior in a vertical direction perpendicular to said transverse direction and said front-to-back direction so as to allow the corresponding terminal to be assembled to the housing from the exterior in the vertical direction under a condition that the elastic mating portion of the corresponding terminal, which is curved for resilient deflection in said transverse direction, extends into the plug-receiving hole.

4. The audio jack assembly as claimed in claim 1 wherein said contact platform extends essentially parallel to the printed circuit board so as to be seated upon the printed circuit board.

5. The audio jack assembly as claimed in claim 4, wherein a post downwardly extends from the contact platform and into a through hole in the printed circuit board for retention.

6. An audio jack connector for electrically connecting with a mating plug, comprising:

an elongate insulative housing defining a mating face, a mounting face perpendicular to the mating face and a plug-insertion hole extending from the mating face into the insulative housing along a mating direction, a first and second slits defined in the mounting face essentially in sequence along the mating direction and in communication with the plug-insertion hole; and a first and second contacts retained in the first and second slits, respectively, each contact comprising a retaining portion securely retained in the slits and an elastic arm extending from the retaining portion and extending into the plug-insertion hole for abutting against the mating plug; wherein said first and second slits are locate adjacent to one common edge of the insulative housing; wherein the elastic arm of the first contact extending along a direction which is against to the mating direction, and the elastic arm of the second contact extend along a direction which is same with the mating direction, and wherein the retaining portion of the first contact is juxtaposed with respect to the retaining portion of the second contact along the mating direction.

7. The audio jack connector according to claim 6, wherein the retaining portions of the first and second contacts are planar shaped and parallel to each other.

8. The audio jack connector according to claim 6, wherein the insulative housing includes an arched bottom wall.

9. The audio jacket connector according to claim 6, wherein each of said slits is dimensioned to be large enough and communicate with an exterior in a vertical direction perpendicular to said mating direction so as to allow the corresponding terminal to be assembled to the housing from the exterior in the vertical direction under a condition that the elastic arm of the corresponding terminal, which is curved for resilient deflection in a transverse direction which is perpendicular to both said vertical direction and said mating direction, extends into the plug-insertion hole.

10. The audio jack connector according to claim 6, wherein the insulative housing includes a base with the edge formed thereon and a connecting portion integrally extending from the edge and extending beyond the base along a transverse direction perpendicular to the mating direction.

11. The audio jack connector according to claim 10, wherein each contact comprises an L-shaped soldering portion extending from the corresponding retaining portion, the soldering portions of the first and second contacts extending beyond the connecting portion to be electrically connected to a printed circuit board.

12. The audio jack connector according to claim 6, wherein a first and second enlarged openings are defined in the mounting face and communicate with the first and second slits, respectively, to accommodate the elastic arms of the first and second contacts.

13. The audio jack connector according to claim 12, wherein the insulative housing forms a pair of position blocks positioned in the first and second openings to abut against corresponding elastic arms with insertion of the mating plug.

14. The audio jack connector according to claim 6 wherein a third slit is defined in the mounting surface adjacent to the edge of the insulative housing to retain a third contact, the first and third slits being substantially in alignment with each other, while the second slit being offset from the first and the third slits along a direction perpendicular to the mating direction.

15. The audio jack connector according to claim 14, wherein the mounting face further defines a third enlarged opening in communication with the third slit, the third contact comprising an elastic arm extending into the third opening, and wherein the elastic arm of the third contact extends along a same direction with respect to the elastic arm of the second contact.

16. An audio jack connector assembly, comprising:

an elongate insulative housing defining a mating face and a plug-insertion hole extending from the mating face into the insulative housing along a mating direction thereof;

a first and second contacts retained in a same side of the insulative housing, each contact comprising a retaining portion and an elastic arm extending from the retaining portion and extending into the plug-insertion hole, the elastic arm of the first contact extending along a direction which is against to the mating direction, and the elastic arm of the second contact extending along a direction which is same with the mating direction; wherein the retaining portions of the first arid second contacts are located in two parallel vertical planes, respectively, and wherein the retaining portion of the first contact is juxtaposed with respect to the retaining portion of the second contact along the mating direction; and a mating plug comprising a first and second contact sections adapted to abut against the elastic arms of the first and second contacts, respectively, with insertion of the mating plug into the plug-insertion hole.

17. The audio jack connector according to claim 16, wherein the insulative housing includes a base and a connecting portion integrally extending from a lateral edge of the base and extending laterally beyond the base.

* * * * *